US008769741B2

(12) United States Patent
Colleran et al.

(10) Patent No.: US 8,769,741 B2
(45) Date of Patent: Jul. 8, 2014

(54) SLEEPING ASSEMBLY

(75) Inventors: Alan John Colleran, Dewsbury (GB); Elizabeth Rose Colleran, Dewsbury (GB)

(73) Assignee: Raskelf Limited, West Yorkshire (GB)

( * ) Notice: Subject to any disclaimer, the term of this patent is extended or adjusted under 35 U.S.C. 154(b) by 244 days.

(21) Appl. No.: 11/883,017

(22) PCT Filed: Jan. 18, 2006

(86) PCT No.: PCT/GB2006/000165

§ 371 (c)(1),
(2), (4) Date: Apr. 28, 2008

(87) PCT Pub. No.: WO2006/079784

PCT Pub. Date: Aug. 3, 2006

(65) Prior Publication Data

US 2009/0044333 A1 Feb. 19, 2009

(30) Foreign Application Priority Data

Jan. 31, 2005 (GB) ..... 0501843.7

(51) Int. Cl.
*A47G 9/08* (2006.01)

(52) U.S. Cl.
USPC ..... 5/413 R; 5/417; 5/413 AM; 5/691; 5/420

(58) Field of Classification Search
USPC ..... 5/413 R, 417, 413 AM, 691, 420
See application file for complete search history.

(56) References Cited

U.S. PATENT DOCUMENTS

| | | | | | |
|---|---|---|---|---|---|
| 5,566,411 | A | * | 10/1996 | Eiler | 5/494 |
| 5,640,725 | A | * | 6/1997 | Ando et al. | 5/413 AM |
| 5,706,532 | A | * | 1/1998 | Kettenhofen | 5/413 R |
| D416,123 | S | * | 11/1999 | Hwang et al. | D2/719 |
| 6,237,171 | B1 | * | 5/2001 | Allen | 5/482 |
| 6,338,173 | B1 | * | 1/2002 | Ramsey | 5/413 R |
| 6,675,414 | B2 | * | 1/2004 | Lamke | 5/413 AM |
| 7,418,748 | B2 | * | 9/2008 | Lamke | 5/413 AM |

FOREIGN PATENT DOCUMENTS

| | | |
|---|---|---|
| DE | 195 22 322 Al | 1/1997 |
| FR | 2 305 154 A | 10/1976 |
| GB | 2 316 603 A | 3/1998 |

OTHER PUBLICATIONS

International Search Report for related International Application No. PCT/GB2006/000165, dated Apr. 28, 2006, 3 pages.

* cited by examiner

*Primary Examiner* — William Kelleher
(74) *Attorney, Agent, or Firm* — Giordano & Chavous LLC

(57) ABSTRACT

A cover for a sleeping assembly with a mattress portion (1) comprising a sheet material envelope having an opening into a first cavity which is capable of substantially enclosing a mattress (4) and a duvet portion (2) comprising a sheet material envelope having an opening into a second cavity which is capable of substantially enclosing a duvet (11) wherein the duvet portion (2) is attached along at least one edge to the mattress portion (1).

10 Claims, 1 Drawing Sheet

SLEEPING ASSEMBLY

This invention relates to a portable integral sleeping assembly for use on supporting surfaces such as those provided, for example, in caravans, motor caravans, boats, mobile homes and other mobile sleeping applications. We use the term mattress in relation to our invention to refer to a supporting base material which is commonly known as an "overlay" or a "topper". Thus the mattress of the invention is not the same as a conventional domestic mattress since the mattress (overlay/topper) of the invention is intended to be used with, i.e. placed on a further resilient surface to ensure the comfort of the user. The resilient surface may be a caravan bunk or seat or a boat seat, for example, though the sleeping assembly of the present invention could be used without a resilient supporting surface with a consequential reduction in comfort. In particular, this invention relates to an integral sleeping assembly comprising a mattress composed of viscoelastic foam.

The conventional sleeping arrangements used in mobile sleeping applications comprise a supporting base which acts as a temporary mattress together with a duvet or sleeping bag and pillows being placed on top of the mattress. For temporary sleeping accommodation such as that in a tent, caravan or boat storage space is limited. Thus, the mattress in these arrangements is also different from a normal domestic mattress and is either a space-saving mattress of normal construction or is an inflatable mattress. The duvet or sleeping bag used in these situations is therefore often much larger than the size of the mattress resulting in a large portion of the duvet or sleeping bag hanging over the free longitudinal side of the mattress. They are also difficult to fold and store. Usually, one of the longitudinal sides of the mattress is in contact with the wall of the vehicle and as a result the duvet or sleeping bag hangs over the free longitudinal side of the mattress. The weight distribution of the excess volume of duvet or sleeping bag is therefore directed over the free longitudinal side of the mattress. As a result it is usual for the duvet or sleeping bag to become separated from the mattress during the night causing discomfort for the user. Also, the user may slide off the mattress during use. Furthermore, the conventional beds in use in mobile sleeping applications are inherently uncomfortable.

A number of integral sleeping arrangements are known in the art which are intended to avoid the problem of separation or movement. For example U.S. Pat. No. 5,640,725 provides a sleeping bag comprising an outer cover, a mattress portion and a coverlet portion. The mattress portion and the coverlet portion are joined along respective first sides thereof. In use the mattress portion and the coverlet portion are joined along respective second sides using a slide fastener means. The mattress portion comprises an air mattress disposed in a body area of the mattress portion between the outer cover and fibrous insulation.

The sleeping bag provided by U.S. Pat. No. 5,640,725 is suitable for use when camping in tents and sleeping on the ground. This arrangement, however, is not suitable for use when sleeping on surfaces provided in boats, camper vans, mobile homes and motor caravans. Furthermore, in order to store the sleeping bag the mattress portion is deflated by releasing air from the air mattress. This therefore has the disadvantage that in order to use successfully the sleeping bag the user will require an extra piece of equipment, i.e. a pump in order to inflate the air mattress. Inflating the mattress will also require additional time and energy. Furthermore, the sleeping bag has the further disadvantage that the air mattress may leak or puncture. This will therefore require the user to repair and maintain or even replace the air mattress in order to use the sleeping bag repeatedly.

When not in use the conventional sleeping arrangements (i.e. the duvets or sleeping bags, the pillows and the mattress) have to be stored away. This can involve the user straightening, rolling and storing each component of the arrangement separately. Alternatively, each component of the conventional sleeping arrangements are straightened separately, brought together and rolled together. Therefore the process of storing the sleeping arrangement requires a significant amount of effort and time and usually involves inflating and deflating the mattress.

It is an aim of the present invention to overcome the various disadvantages of or improve on the prior art arrangement. It is an aim of the present invention to provide a sleeping assembly in which the duvet and the mattress form a single unit. It is a further aim of the present invention to provide a sleeping assembly in which the mattress and the duvet are sized so as to be used in mobile sleeping applications. It is a still further aim of the present invention to provide a sleeping assembly which when not in use can be easily stored as a single unit. It is a still further aim of the present invention to provide a sleeping assembly which does not require any additional pieces of assembly in order to function. It is a still further aim of the present invention to provide a sleeping assembly which provides the user with a comfortable night of sleep and warmth. It is a still further aim of the present invention to provide a sleeping assembly which requires less maintenance than the prior art devices. Another aim is to provide a sleeping assembly which can easily be washed and cleaned.

The present invention satisfies some or all of the above aims.

Accordingly in a first aspect, the present invention provides a cover for a sleeping assembly comprising:

(a) a mattress portion comprising a sheet material envelope having an opening into a first cavity which is capable of substantially enclosing a mattress; and (b) a duvet portion comprising a sheet material envelope having an opening into a second cavity which is capable of substantially enclosing a duvet;

wherein the duvet portion is attached along at least one edge to the mattress portion.

In a second aspect, the present invention provides a sleeping assembly comprising:

(a) a mattress portion comprising a sheet material envelope having an opening into a first cavity which substantially encloses a mattress composed of a viscoelastic foam; and (b) a duvet portion comprising a sheet material envelope having an opening into a second cavity which substantially encloses a duvet;

wherein the duvet portion is attached along at least one edge to the mattress portion.

The duvet portion and the mattress portion can be permanently or releasably secured to one another along the edge by which they are joined. In a preferred embodiment the duvet portion and the mattress portion are releasably secured to one another. They can be secured by means of a zip fastening, one or more buttons and corresponding eyelets, or a touch-contact fastening such as Velcro™ or a press-stud, a buckle, a loop and hook arrangement or clip. Preferably, the two parts of the sleeping assembly are fastened by means of a zip fastener. Using separate portions has the advantage of making storage easier and also facilitates laundering of the sheet material which forms the mattress cover and the duvet cover.

In an alternative embodiment the sheet material which forms the mattress cover and the duvet cover is a single piece of sheet material. Where the join is permanent, this might be achieved by securing two pieces of material together. Equally, the assembly could be formed from a single piece of sheet material in which seams formed by stitching in one or more layers of the sheet material provide a line separating the mattress portion and the duvet portion. The sleeping assembly can then be folded along this line.

In use the mattress portion is placed on the ground or on a suitable supporting surface which is usually a cushioned surface such as a caravan bunk, or caravan seat or boat seat. The duvet portion is then folded back over the mattress portion with the fold line being the join along the edge where the two parts are secured to one another. In this way the duvet portion overlays the mattress portion so that the lower surface of the duvet portion and the upper surface of the mattress portion define a sleeping area.

In an embodiment, the sleeping assembly may incorporate a further base material to improve the comfort of the user. The base material is a resilient material, and can be any resilient material but is preferably foam such as viscoelastic foam. The base material may be incorporated inside the mattress portion, usually underneath the viscoelastic foam, or may be separate from the sleeping system and be placed underneath. This means the sleeping system can be used on a hard surface without any reduction in comfort.

Normally, the edge which is secured will be one of the long edges that forms the side of a mattress which is parallel to the user when lying on the mattress. This may be defined as the first longitudinal edge of the mattress. The shorter edge along the bottom, i.e. foot end of the mattress which can be defined as the transverse edge may also include either wholly or in part a join between the mattress portion and the duvet portion so that the two parts of the sleeping assembly are also joined at this edge. The join may be releasable or permanent and thus can be fastened in the same way as the join along the long edge at the side of the mattress. The manner of fastening need not be identical however.

Preferably the mattress portion and the duvet portion are further enclosed within a single outer cover. The covers may be composed of any suitable fabric material such as, for example, cotton, nylon or polyester. Preferably at least one of the mattress cover, the duvet cover and the outer cover are polycotton sheets. It is especially preferred that the covers of the assembly are removable so that the covers can be cleaned. In a preferred embodiment the outer cover includes a design or logo thereon.

The longitudinal length of the duvet portion may be equal to or less than the longitudinal length of the mattress portion. In a preferred embodiment the longitudinal length of the duvet portion is less than the longitudinal length of the mattress portion so that the duvet portion does not cover the head of the user. Therefore, the sleeping assembly has a body portion (i.e. the portion of the mattress portion which is enclosed by the duvet portion) and a head portion (i.e. the portion of the mattress portion which is not enclosed by the duvet portion).

In a preferred embodiment, the duvet portion is sufficient in transverse length to provide sufficient overhang of the duvet beyond the edge of the mattress portion, when in use, to prevent heat loss from the user.

The duvet portion is preferably attached to the mattress portion along the bottom (transverse) edge of the sleeping assembly at the foot end so as to provide a cavity between the inner (lower) surface of the duvet portion and the inner (upper) surface of the mattress portion which is sufficient to allow for movement of the user.

In another embodiment, the duvet portion may be further attached along the second longitudinal edges of the duvet portion and the mattress portion. The method of attachment of the duvet portion to the mattress portion along the second longitudinal edge can be as described previously though it need not be the same as the attachment used along the first longitudinal edge. Preferably it is releasable.

The first longitudinal edges of the duvet portion may be attached to the corresponding first longitudinal edge of the mattress portion along a portion of or along the entire length of the edge of the duvet portion. In a preferred embodiment the duvet portion is attached to the mattress portion along the entire length of the first longitudinal edge of the duvet portion.

Preferably, the second longitudinal edge of the duvet portion is attached to the mattress portion along at least about 10%, more preferably at least 25%, still more preferably at least 40% of the length of said edge. Preferably, the second longitudinal edge of the duvet portion is attached to the mattress portion along less than about 95%, more preferably less than about 75%, still more preferably less than about 60% of the length of said edge.

Since, in a preferred embodiment, the fastenings along the foot of the assembly and/or along the second longitudinal edge of the assembly are removable the present invention has the advantage that the sleeping assembly can be either right or left handed. In order to transform the assembly from being a left handed assembly into a right handed assembly, the assembly is rotated about the longitudinal axis of the assembly and the duvet portion overlays the upper surface of the mattress portion. Even when the bottom is permanently fastened, e.g. by sewing, the sleeping assembly can be reversed, i.e. from left-handed to right-handed or vice versa by simply pushing/pulling inside out in the same way that a jacket can be reversed. A left-handed and a right-handed sleeping assembly can then be pushed together to provide a double sleeping assembly for two persons.

Similarly, because the duvet portion and the mattress portion in one preferred embodiment form one integral unit the duvet portion is unable to separate from the mattress during use. Hence discomfort of the user is avoided.

In use, the sleeping assembly has at least one opening transversely to the length of the sleeping assembly which provides a cavity defined by the inner surface of the duvet portion and the upper surface of the mattress portion.

The duvet portion of the sleeping assembly preferably further comprises an overhanging portion which protrudes from and extends along at least part of the unattached section of the second longitudinal edge of the duvet portion. In use the overhanging portion hangs over the free longitudinal side of the mattress portion. Other conventional sleeping devices such as for example sleeping bags have the disadvantage that in use the cover portion and the mattress portion are secured so that typically only the transverse head edge remains unattached. This has the disadvantage that the user finds it difficult to get into and out of the sleeping bag and furthermore the user feels trapped within the sleeping bag. The sleeping assembly of the present invention has the advantage that, in a preferred embodiment, at least a portion of the second longitudinal edge of the duvet portion is not attached to the mattress portion. This therefore allows the user to get into the cavity of the assembly more easily. Furthermore, due to the presence of the overhanging portion the movements of the user are not restricted and the user is kept warm.

In a further embodiment, the sleeping assembly includes a cavity or pocket to receive a pillow. The cavity or pocket is formed as an envelope of sheet material and thus defines a pillow receiving section which may form part of the mattress cover or may be releasably attached to the mattress cover. The pillow is received and enclosed within the pillow receiving section. In an alternative embodiment, the sleeping assembly includes a pillow which is formed as an integral part of the mattress portion.

The mattress portion is composed of a viscoelastic foam which is also known as "memory foam". This foam has the advantage that the mattress portion conforms to the body shape of the user. Viscoelastic foam is made from polyurethane however this foam has a different cell structure to other known foams. Viscoelastic foam has an open-celled material that is both temperature and weight sensitive. As the temperature of the foam increases the foam becomes softer and more pliable. Therefore, in use the viscoelastic foam adapts around the shape of the body of the user due to a combination of weight distribution and the increase in temperature of the foam which is in contact with the body. As the position of the body changes the viscoelastic foam adjusts to the resulting shape.

As a result of its cell structure, viscoelastic foam is less "springy" and slower to recover than other known foams.

The recovery of the original shape of the foam is thus damped relative to the recovery of a normal mattress. The combination of the damped recovery and the temperature sensitive nature of the foam provides the user with a very comfortable support for sleeping on.

Therefore, the sleeping assembly of the present invention has the advantage that it provides the user with increased comfort due to the fact that the mattress portion provides the body with an even support rather than having pressure concentrated at the shoulders, hips and feet of the user.

This also has the advantage that the sleeping assembly of the present invention is easier to roll up to store without the user having to compete against opposing forces from the mattress.

Viscoelastic foam also has beneficial medical properties in that it provides a pressure-relieving support. Thus the sleeping assembly of the invention also provides a good support for people with arthritis or stiff joints or other similar medical conditions.

The mattress portion preferably has a thickness of greater than 0.6 mm (0.25 inches), more preferably greater than 25 mm (1 inch), for example 50 mm (2 inches). Preferably the thickness of the mattress portion is less than 125 mm (5 inches), more preferably less than 100 mm (4 inches), for example 75 mm (3 inches).

In a preferred embodiment, the density of the memory foam used to form the mattress of the present invention is greater than 20 kg/m$^3$, more preferably greater than 40 kg/m$^3$, especially preferably greater than 50 kg/m$^3$, for example 70 kg/m$^3$. Preferably the density of the mattress is less than 120 kg/m$^3$, more preferably less than 100 kg/m$^3$, for example 90 kg/m$^3$.

A further advantage of the sleeping assembly of the present invention that the sleeping assembly can be used throughout the year. Therefore the duvet can be selected from a range of summer and winter duvets which can be interchangeably incorporated into the duvet portion as required. The tog value of the duvet is preferably 3 for a summer duvet and preferably 16 for a winter duvet.

The mattress and/or duvet may also include a cover to protect the mattress and/or duvet. The mattress and/or duvet is thus encapsulated by a protective cover of a conventional type before being placed in the appropriate pocket of the sleeping assembly which is formed by an envelope of sheet material.

When not in use the sleeping assembly is rolled up and stored away. The sleeping assembly of the present invention therefore has the advantage that it does not require any additional preparation for storage such as the removal of one or more components of the assembly and storing the components separately or deflating the mattress. The sleeping assembly of the present invention is rolled up as a single unit. Straps (which may be elastic or inelastic) can be provided at one or more edges to retain the rolled up sleeping assembly.

The sleeping assembly has the further advantage that the material used for the mattress (i.e. viscoelastic foam) does not resist being rolled up and stored. Hence, once rolled up, the sleeping assembly is secured in the rolled position using any suitable means, such as straps which are preferably attached to the head or foot of the mattress portion. The straps loop around and secure the outer surface of the rolled up sleeping assembly. The sleeping assembly may additionally comprise a bag which can be secured to one of the edges of the sleeping assembly. Once the sleeping assembly has been rolled up the sleeping assembly may be placed within the bag and stored.

Embodiments of the invention will now be described by way of example with reference to the accompanying drawings, in which.

Figure 1:
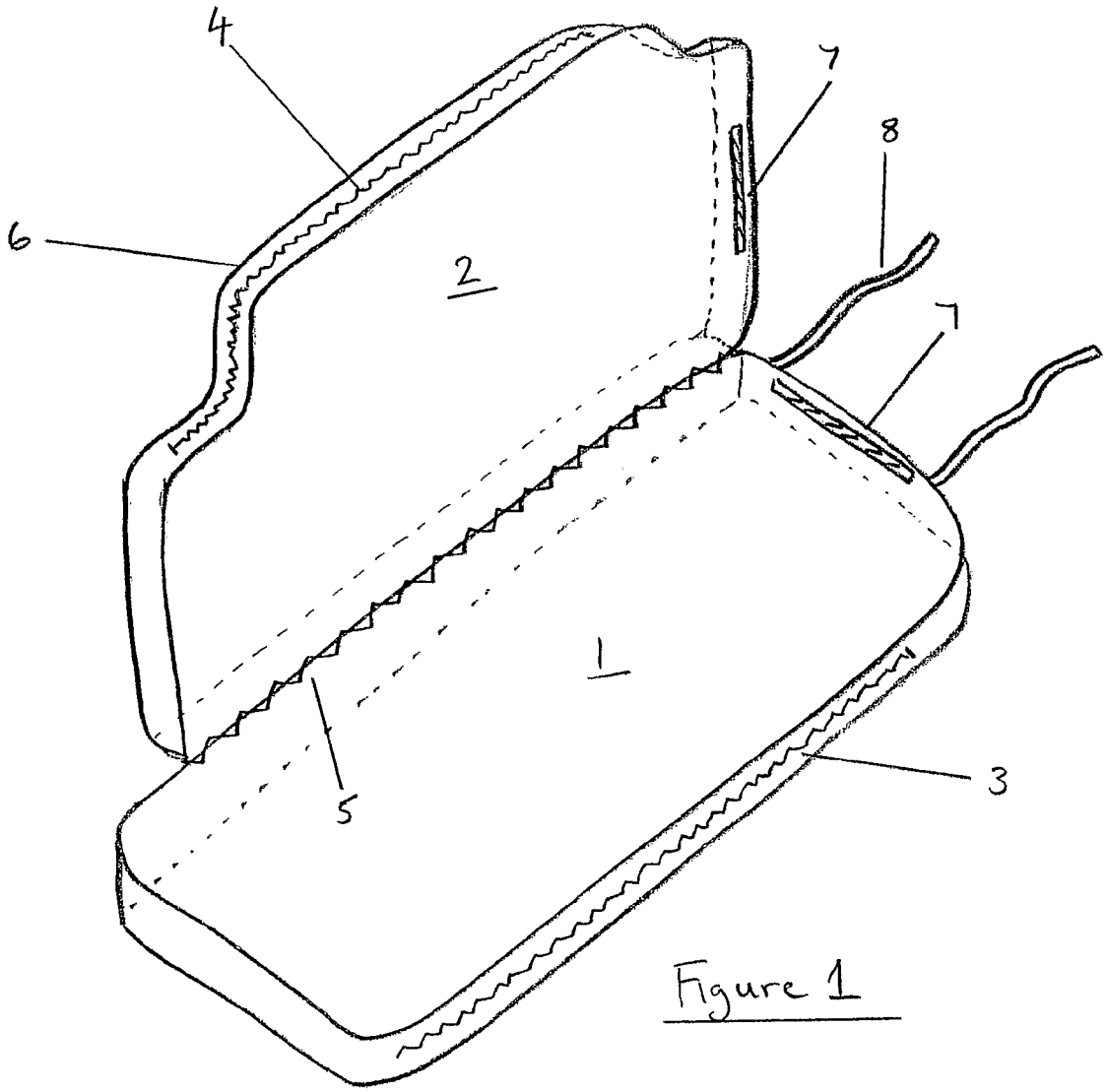
FIG. 1 shows the top view of the sleeping assembly (without the duvet and the mattress).

FIG. 1 shows the top view of the sleeping assembly of the present invention without the duvet and the mattress. The present invention comprises a mattress portion 1 comprising a sheet material envelope and a duvet portion 2 also comprising a sheet material envelope. The sheet material envelope of the mattress portion 1 has an opening which can be releasably secured by zip fastening 3 defining a first cavity which substantially encloses a mattress (not shown). The sheet material envelope of the duvet portion 2 has an opening which can be releasably secured by zip fastening 4 defining a second cavity which substantially encloses a duvet (not shown). However, other releasable fastenings can be used in place of either zip fastening 3 or zip fastening 4. Alternatively, the sheet material envelopes of the mattress portion 1 and the duvet portion 2 could be permanently fastened (not shown) along the openings 3 and 4 by sewing the envelope together after insertion of the mattress and/or duvet.

The mattress portion 1 and the duvet portion 2 are releasably attached to one another along one long edge of the mattress (first longitudinal edge) by a zip fastening 5. Alternatively, the duvet portion 2 and the mattress portion 1 can be releasably attached using other means (not shown). The duvet portion 2 and the mattress portion 1 could also be permanently attached (not shown) by sewing the two portions together.

The duvet portion 2 further comprises an overhanging portion 6 which protrudes from and extends along at least a part of the second longitudinal edge of the duvet portion 2. In use and once folded over the mattress (see FIG. 2) the overhanging portion 6 hangs over the free longitudinal side of the mattress portion 1.

The duvet portion 2 and the mattress portion 1 may be attached along more than one side of the sleeping assembly. For example, the duvet portion 2 and the mattress portion 1 may be attached to each other along the shorter edge along the bottom, i.e. the foot end of the mattress (transverse edge) by Velcro® attachments 7. As discussed above the duvet portion 2 and mattress portion 1 can be attached by any suitable means. The duvet portion 2 may also be further attached to the mattress portion along a second longitudinal edge of the mattress portion 1 (not shown).

When not in use, the sleeping assembly is rolled up and stored away. Straps 8 (which may be elastic or inelastic) are provided at the foot end of the mattress portion 1 to retain the rolled up sleeping assembly. Alternatively, these straps can be provided at one or more other edges of the sleeping assembly (not shown).

Figure 2:
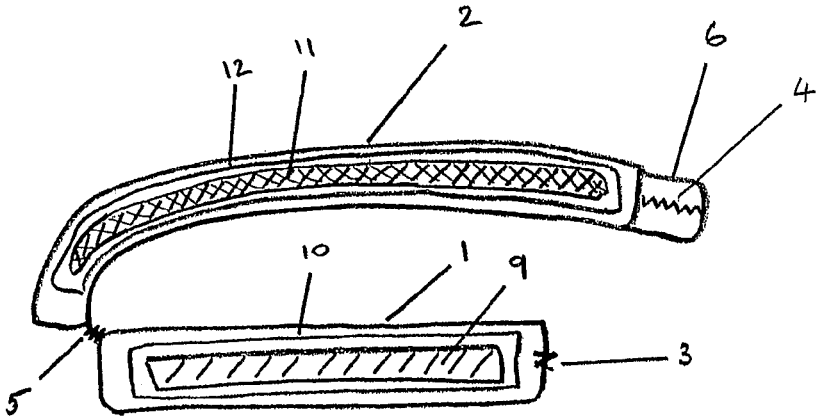
FIG. 2 shows the cross-sectional view from the head end of the sleeping assembly (including the duvet and the mattress).

FIG. 2 illustrates the cross-sectional view of the sleeping assembly including the mattress 9, the mattress cover 10, the duvet 11 and the duvet cover 12. The mattress 9 (and optional mattress cover 10) is substantially enclosed by the material sheet envelope of the mattress portion 1. The sheet material envelope is fastened using a zip fastener 3. The duvet 11 (and optional duvet cover 12) is substantially enclosed by the material sheet envelope of the duvet portion 2. Again, the sheet material envelope is fastened using a zip fastener 4. The mattress portion 1 is attached to the duvet portion 2 by a zip fastener 5.

The invention claimed is:

1. A portable sleeping assembly comprising:

a) a mattress portion, the mattress portion being a first envelope that defines a first cavity and has a first opening into which a resilient mattress is placed, thereby forming the mattress portion, wherein the resilient mattress comprises a viscoelastic foam;

(b) a duvet portion, the duvet portion being a second envelope that defines a second cavity and has a second opening into which a duvet is enclosed, thereby forming the duvet portion;

wherein the duvet portion is attached along at least one edge to the mattress portion, the duvet portion further comprising a first overhang extending beyond the longitudinal edge of the mattress portion to prevent heat loss from the user;

wherein the duvet portion is permanently attached to the mattress portion at the transverse edge of the foot end of the sleeping assembly;

wherein the duvet portion further comprises a second overhang extending beyond the transverse edge of the foot end of the mattress portion;

wherein the portable sleeping assembly transforms between righthanded and lefthanded configurations; and wherein the portable sleeping assembly is configured to be mobile and stored as a single unit.

2. The portable sleeping assembly as claimed in claim 1, wherein the mattress portion and the duvet portion are a single piece of sheet material.

3. The portable sleeping assembly as claimed in claim 1, wherein the sleeping assembly further comprises a base material to improve the comfort of the user.

4. The portable sleeping assembly as claimed in claim 3, wherein the base material is a resilient material.

5. The portable sleeping assembly as claimed in claim 1, wherein the mattress portion and the duvet portion are further enclosed within a single outer cover.

6. The portable sleeping assembly as claimed in claim 1, wherein the duvet portion is further attached to the mattress portion along the second longitudinal edges of the duvet portion and the mattress portion.

7. The portable sleeping assembly as claimed in claim 6, wherein the duvet portion is further attached to the mattress portion along the second longitudinal edges of the duvet portion and the mattress portion.

8. The portable sleeping assembly as claimed in claim 1, wherein the sleeping assembly includes a cavity or pocket to receive a pillow.

9. The portable sleeping assembly as claimed in claim 1, wherein the duvet comprises a duvet having a tog value of 3 for summer or a duvet having a tog value of 16 for winter.

10. The portable sleeping assembly as claimed in claim 1, wherein the duvet portion is attached to the mattress portion at the transverse edge of the sleeping assembly to form a cavity.

* * * * *